US007981248B2

(12) United States Patent
Grace

(10) Patent No.: US 7,981,248 B2
(45) Date of Patent: Jul. 19, 2011

(54) GAS FREE VALVE FOR PULP VACUUM WASHER AND METHOD

(75) Inventor: Todd S. Grace, Alpharetta, GA (US)

(73) Assignee: Andritz Inc., Glen Falls, NY (US)

( * ) Notice: Subject to any disclaimer, the term of this patent is extended or adjusted under 35 U.S.C. 154(b) by 0 days.

(21) Appl. No.: 12/860,991

(22) Filed: Aug. 23, 2010

(65) Prior Publication Data

US 2010/0314062 A1 Dec. 16, 2010

Related U.S. Application Data

(62) Division of application No. 11/762,111, filed on Jun. 13, 2007, now Pat. No. 7,780,815.

(60) Provisional application No. 60/829,313, filed on Oct. 13, 2006.

(51) Int. Cl.
*D21C 9/02* (2006.01)

(52) U.S. Cl. ..... 162/60

(58) Field of Classification Search ..... 162/60, 162/217, 13; 210/404, 406, 429
See application file for complete search history.

(56) References Cited

U.S. PATENT DOCUMENTS 3,363,774 A * 1/1968 Luthi ..... 210/404
4,154,687 A 5/1979 LaValley
4,383,877 A 5/1983 LaValley
4,419,165 A 12/1983 LaValley
4,683,059 A 7/1987 LaValley
4,822,488 A * 4/1989 Shatuck ..... 210/404
5,264,138 A 11/1993 Heino et al.
5,503,737 A 4/1996 Luthi
5,683,582 A 11/1997 Luthi
6,631,810 B1 10/2003 Lamas et al.
7,575,658 B2 * 8/2009 Grace ..... 162/60

FOREIGN PATENT DOCUMENTS

CA 2 062 957 1/1991
CA 2 182 833 2/1997
WO 2008/063122 5/2008

* cited by examiner

*Primary Examiner* — Mark Halpern
(74) *Attorney, Agent, or Firm* — Nixon & Vanderhye P.C.

(57) ABSTRACT

A method of treating pulp on a porous surface of a rotating drum cylinder having a lower drum portion in a vat of pulp slurry and a radial array of filtrate conduits including: as the porous surface of the drum rotates through the vat, drawing filtrate from the slurry through the porous surface by the application of a suction to the filtrate conduits vacuum; draining the filtrate from the filtrate conduits into the filtrate chamber and to a filtrate suction conduit extending to an elevation below the vat; forming a pulp mat on the porous surface which passes filtrate and substantially blocks fibers in the pulp slurry; removing the pulp mat on the porous surface from the vat as the drum rotates; draining filtrate from the filtrate suction conduit, and before excessive gases passing through the porous surface enter the filtrate conduits, switching a fluid flow downstream of the filtrate conduits to a gas vent passage offset and below from a drum rotational axis.

14 Claims, 4 Drawing Sheets

GAS FREE VALVE FOR PULP VACUUM WASHER AND METHOD

CROSS RELATED APPLICATION

This application is a divisional of application Ser. No. 11/762,111 filed Jun. 13, 2007 and claims the benefit of application Ser. No. 60/829,313 filed Oct. 13, 2006, both of which are incorporated in their entirety by reference.

BACKGROUND OF THE INVENTION

The field of the invention is rotary drum vacuum filters used in the pulp and papermaking industry to form a mat of wood pulp and separate the mat from its filtrate. In particular, the invention relates to gas vent on the drum suction control valve in the discharge elbow assembly of the filter.

FIG. 1 shows a rotary drum vacuum filter 10 that includes a rotary drum 12 in a vat 14 of pulp slurry. The drum is partially submerged in a pulp slurry vat vessel, such as up to the horizontal centerline of the drum. The drum turns in a clock-wise direction at a preferred rate of approximately 2 to 4 revolutions per minute (RPM) and most preferably at 3 RPM. As the outer drum surface rotates through the slurry (3:00 to 9:00 positions), a pulp mat 16 forms on the outer face 17 of the drum.

To promote mat formation, suction is applied to the drum porous outer surface 17, e.g. a screened or wire surface. The porosity of the surface 17 is sufficiently fine to retain fibers on the surface and pass primarily filtrate into the channels 18 behind the porous surface. The channels 18 are arranged in a longitudinal array behind the screen and extending the length of the drum. The channels drain into radial channel 20, or tubes, that lead to a central filtrate chamber 28.

As the surface 17 of the drum travels up and out of the vat (corresponding to the 9:00 to 12:00 rotational positions of the drum), the pulp mat 16 on the surface is washed with a liquid spray 22, e.g., wash water, that cleans the pulp mat of chemical liquor. The suction draws the water and liquor from the pulp mat into the channels 18 behind the drum surface 17. The channels continue to drain into the channels 20 which drain into the filtrate chamber that is typically at one end of the drum and coaxial to the drum.

As the drum surface passes over the top rotational position (12:00 to 1:00), the wash water spray is stopped. As the drum rotates towards the 2:00 position, the suction stops, but water continues to drain through the pulp and into the channels and ribs. Air also starts to enter the channels and ribs because of the stoppage of wash water.

The concentrated pulp is generally referred to as a pulp cake. As the drum rotates through to the 2:00 to 3:00 position, a scraper 24 removes the pulp mat from the drum surface. The pulp cake is collected in a chamber 26 for further processing.

Vacuum washers typically receive a low consistency pulp slurry (1.5% pulp by weight) in the vat vessel. The pulp is thicken as the drum surface rises on the drum surface out of the vat to about a 10% consistency. The pulp is further thickened to a discharge consistency from the drum of 12% or greater.

After the cake is removed, the channels and ribs are typically filled with air. As the drum surface (now scraped clean of the pulp mat) rotates past the 3:00 position, the surface renters the vat 14. Suction is reapplied to the channels and ribs after the surface is submerged into the vat. A pulp mat 16 begins to form again on the drum surface 17. The formation of a pulp mat, water cleaning of the mat, and scraping of the map off the drum is a continuous process that occurs as the drum rotates.

The motive force for the suction on the drum surface is the vacuum created as the extracted filtrate drops approximately 30 feet (ft.) to 40 ft. (10 to 13 meters) from the rotary drum vacuum washer 10 to a filtrate tank (below the washer). The pipe through which the filtrate passes is known as a drop leg 32 (FIG. 2).

FIG. 2 shows a conventional end of a rotary vacuum filter having a drum 12 and a drainage path for liquor and wash water (collectively filtrate) that flows from the longitudinal channels 18 (FIG. 1) and radial channels to a filtrate chamber 28 typically at one end of the filter 10 and coaxial to the drum. Suction to the drum surface 17 is generally provided through the channels 18 that extend behind the screen on the drum face 17. Liquor and water (collectively "filtrate") enter the channels and are drawn by suction into rib conduits that extend radially and partially axially from the channels near the drum face to an filtrate chamber 28 typically at one end of the drum.

The axial filtrate chamber 28 provides a drainage path for the flow of filtrate from the ribs and channel in the drum. The filtrate chamber 28 is traditionally coupled, (through a trunnion conduit 34 and an elbow joint 30), to a drop leg conduit 32 that drains the filtrate flow down below the vat 14 to a filtrate collection vessel (not shown).

The drainage of the filtrate into the drop leg 32 creates a suction that draws the filtrate through the filtrate chamber 28, ribs 20 and channels 18. To maintain high levels of suction, gas, e.g., air, should not flow into (or at least not become excessive) in the chamber 28, elbow 30 or drop leg 32. If too much air enters the drop leg, the suction level (sub-atmospheric pressure) lessens, the flow of liquid filtrate into the drop leg may be interrupted such that reduced suction will be applied to the filtrate chamber 28, ribs and channels and air enters the filtrate flowing through the drop leg which may cause the filtrate to foam and require downstream processing to remove the air. Accordingly, there is along felt need to prevent gas from entering the elbow joint 30 and drop leg 32.

FIG. 2 shows an exemplary prior art approach to preventing gas from entering the elbow joint 30 and drop leg 32. The filtrate chamber 28 in the drum 12 is coupled to a trunnion conduit 34 that rotates with the drum. The trunnion conduit 34 is driven through a worm gear 36 and a matching drive worm gear collar 37 to rotate the drum. The elbow 30 and down leg 32 conduits are stationary. An inlet end of the elbow is coupled to the outlet of the rotating trunnion conduit. FIG. 2 is an exploded view of the trunnion conduit and elbow and down leg. In practice, the outlet of the trunnion conduit is rotatably coupled to the inlet to the elbow conduit 30 and the elbow and down leg 32 conduits are connected.

A center shaft 38 extends from the elbow into the trunnion conduit 34. The center shaft is of a relatively small diameter as compared to the inner diameter of the filtrate passage in the elbow and down leg. The center shaft 38 is hollow to allow gases in the filtrate to vent into the shaft and avoid entering the filtrate passage in the elbow 30 and down leg 32.

The center shaft supports a valve segment 40 that includes a generally arc shaped section that extends from about the 1:00 position to the 5:00 position relative to the rotation of the drum. The outer face of the valve segment is positioned in the filtrate chamber and juxtaposed against the drainage outlets for the ribs 20 (as the ribs pass through the 1:00 position to the 5:00 position). The drainage outlets of the ribs open to the filtrate chamber 28.

The valve segment blocks the outlets of the ribs in the drum as the ribs rotate through the 1:00 to 5:00 positions. The arc width of a conventional valve segment is typically about 130 degrees which corresponds to rotating the drum through the 1:00 to 5:00 positions. The ribs are prevented by the valve segment from draining to the filtrate chamber 28 and into the trunnion conduit. As the ribs rotate from 1:00 to 5:00, filtrate and gases, e.g., air, in the ribs are intended to remain in the ribs. The valve segment 40 prevents most of the gases in the ribs from flowing into the filtrate chamber 28 and to the trunnion conduit 34, elbow conduit 30 and down leg conduit 32.

The valve segment 40 also prevents suction from being applied to the ribs as the ribs pass from the 1:00 to 5:00 positions. Suction is neither needed nor desired as the surface 17 of the drum passes from the 1:00 to 5:00 positions because gravity holds the pulp mat 16 on the surface until the scraper 24 (FIG. 1) removes the pulp cake 16 at about the 2:00 to 3:00 position. Suction if applied from the 1:00 to 5:00 positions would draw air into the channels and ribs and impede removal of the pulp mat.

The valve segment 40 does not block the application of suction to the ribs or the drainage of filtrate from the ribs as the ribs rotate from the 5:00 position to the 1:00 position. As the ribs move through the vat, suction (applied through the ribs by the down leg) draws a pulp slurry onto the drum face screen and pulls filtrate through the screen and into the channels, ribs and to the filtrate chamber 28. Similarly, as the ribs move up out of the vat to the top drum position (3:00 to 12:00), the suction draws filtrate, including the wash water, through the screen and into the channels, ribs and filtrate chamber. The flow of filtrate into the ribs moving from the 5:00 position to the 1:00 position is sufficient to create a substantial suction as the filtrate flows into the elbow conduit 30 and down leg conduit 32. Substantial amounts of air are prevented from entering the elbow and down leg because the channels and ribs are substantially filled with liquid filtrate as the channels are submerged in the vat and pass under the water spray, which occurs as the drum moves from the 5:00 position to the 1:00 position. After the channels rotate past the water spray (at about the 12:00 to 1:00 position), the outlets to the ribs are block by the valve stem to prevent gas from entering the filtrate chamber and trunnion conduit.

The valve segment 40 does not prevent all gases from entering the elbow and down leg. Air enters the ribs as the liquid filtrate drains from the ribs rotating from the 1:00 position until the channels for the ribs enter the vat. The air remains in the rib as the rib rotates down into the drum. As the drum is submerged and filtrate fills the ribs, a filtrate air mixture, e.g., foam, occurs in the ribs and can flow into the filtrate chamber 28. The residual air and foam in the ribs should not be drawn into the filtrate chamber, trunnion conduit, elbow conduit and down leg conduit as suction is applied to the ribs. However, when suction is reapplied as the outlet of the ribs rotate past the 5:00 position, the residual air and foam in the ribs flow into the filtrate chamber. This air and foam may be sufficient to reduce the suction created by the drop leg, and create air bubbles in the trunnion.

Air in a washer is detrimental because: (i) when the air is in the filtrate and the cake, it creates resistance to the flow of filtrate through the cake; (ii) air entrained in the filtrate and cake creates foam that is very stable and the foam must typically be eradicated with a costly defoaming agent, and (iii) air in the drop leg results in a lower vacuum created by the drop leg thereby reducing the motive force by which the washer operates.

Prior attempts to vent gases from the filtrate have included adding a gas vent slot in the valve segment that is in fluid communication with the inner conduit formed by the hollow center shaft 38. See e.g., U.S. Pat. No. 5,264,138. The slot may be aligned with the 3:00 to 5:00 position on the drum such that as the channels and ribs rotate down into the vat, the filtrate entering the ribs forces air into the slot and out through the center shaft (rather than into the filtrate chamber and trunnion conduit). The center shaft has a gas vent and a filtrate drain that extends externally of the elbow. The center shaft removes gases in the ribs that would have otherwise entered the elbow. The filtrate drain on the center shaft removes liquid filtrate that enters the hollow shaft with the gases. The gas vent removes gases from the filtrate that are directed into the center shaft. A difficulty with this approach to venting gases is that the center shaft is elevated at or above the liquid level of the vat such some of the air and foam remain in the ribs. The vat fills the ribs with filtrate liquid only to a level in the ribs that is no higher than the vat level. The gap in the ribs between the vat liquid level and center shaft 38 remains filled with air. Another difficulty with the slot open to the center shaft is that the slot is relatively narrow, e.g., 16 degrees, and the center shaft is narrow. The narrow slot and center shaft may not be sufficient to allow gas and foam to vent from the ribs, especially if the drum rotates relatively fast, e.g., above 3 RPM. Another approaches to providing a gas vent for a rotary drum filter include the LaVally valve shown in, for example, U.S. Pat. No. 4,683,059, and the air inflow restrictors shown in U.S. Pat. Nos. 5,683,582 and 5,503,737. However, there remains a long felt need for improved devices and methods for venting gases before they enter the elbow and down leg conduits of a rotary drum filter.

BRIEF DESCRIPTION OF THE INVENTION

A gas vent has been developed for a valve segment of a rotary vacuum drum filter for condensing and washing pulp from a slurry to a pulp cake. The gas vent exhausts air in the filtrate piping, e.g., channels and ribs, of the drum before the air flows into a down leg where it could interrupt the suction needed for the drum.

The gas vent is offset from the drum axis and has a large area inlet to vent all gases in the drum piping, even for fast rotating drums.

In a rotary drum for condensing pulp from a pulp slurry vat, the drum including drainage pipes delivering filtrate from a pulp mat on an outer surface of the drum to a filtrate conduit coaxial with a drum rotational axis, a valve segment has been developed for the filtrate conduit comprising: an outer surface juxtaposed against drainage outlets of the pipes as the pipes pass air received as the pulp mat is removed from the drum (e.g., angular positions of substantially 1:00 to 5:00, wherein the valve segment does not block the drainage outlets during a majority of the rotation of the drum while filtrate is discharged from the outlets; an inlet aperture on the outer surface of the valve segment aligned with the drainage outlets of the pipes, said inlet aperture extending at least a majority of a arc of the valve segment; a closed passage extending from the inlet aperture to a gas vent external to the filtrate conduit, wherein the closed passage is offset from and extends above and below the horizontal centerline of the filtrate conduit.

The valve segment may include a lower edge of the inlet aperture at an elevation no higher than a liquid level of the slurry vat and a lower portion of the closed passage at an elevation that is no higher than a liquid level of the slurry vat. The valve segment may comprise an outer plate supported on a support plate. The support plate may have an arc shape and conform substantially to an inner wall of the filtrate conduit and an inner support plate attached to the outer plate, wherein the closed passage is formed between the support plates.

A rotary drum filter has been developed for removing filtrate from paper pulp comprising: a housing including a chamber to receive a vat of a pulp slurry; a rotatable drum cylinder mounted in the housing wherein a portion of the drum cylinder extends down into the vat, the drum cylinder including a screen surface to receive a mat of pulp as the drum rotates through the vat; an array of filtrate conduits in the drum in fluid communication with the screen surface and having outlets at a filtrate chamber coaxial with a rotational axis of the drum; a stationary suction conduit coupled to the filtrate chamber receiving the filtrate flowing through the screen surface, filtrate conduit and filtrate chamber, wherein the suction conduit extends to an elevation below (e.g., 30 feet or 10 meters below) the vat to create a suction in the filtrate chamber, filtrate conduit and at the screen surface; a stationary valve segment in the filtrate conduit including an outer surface juxtaposed to block the outlets of the filtrate conduits only while the filtrate conduits are rotated from an elevated position down into the vat and while the conduits fill with air; said stationary valve segment includes an inlet aperture aligned with the outlets of the filtrate conduits and a passage extending from the inlet aperture to a gas vent external to the filtrate conduit, wherein the closed passage is offset from and below a centerline of the filtrate conduit.

The rotary drum filter may include a lower edge of the inlet aperture at an elevation no higher than a liquid level of the slurry vat and a lower portion of the closed passage at an elevation no higher than a liquid level of the slurry vat. The valve segment may be attached to a support outer plate having an arc shape and conforming substantially to an inner wall of the filtrate conduit. The outer support plate may be attached to an inner plate, wherein the closed passage is formed between the support plates. The valve segment may include an aperture plate including the inlet aperture and the aperture plate mounted on the outer surface.

A method has been developed for treating pulp including the formation of a pulp web on a porous surface of a rotating drum cylinder having a lower portion in a vat of a pulp slurry and a radial array of filtrate conduits for draining filtrate passing through the porous surface to an axial filtrate chamber, the method comprising: as the porous surface of the drum rotates through the vat, drawing filtrate from the slurry through the porous surface by the application of a suction to the filtrate conduits vacuum; draining the filtrate from the filtrate conduits into the filtrate chamber and to a filtrate suction conduit extending to an elevation below the vat; forming a pulp mat on the porous surface which passes filtrate and substantially blocks fibers; removing the pulp mat from the vat by rotating the porous surface of the drum rotates up and out of the vat; continuing the draining of filtrate from the filtrate suction conduit as the filtrate conduits are rotated through angular positions at which fluid applied to the surface of the pulp is sufficient to fill the conduits; after fluid is no longer applied to the pulp mat and before excessive gases passing through porous surface enter the filtrate conduits, switching the fluid flow from the filtrate conduits from a liquid fluid path directed to the filtrate suction conduit and to a gas vent passage, wherein the gas vent passage is offset and below from a drum rotational axis.

The method may further including switching the liquid fluid path directed to the filtrate suction conduit and to the gas vent passage at substantially a 1:00 rotational position of the drum. The method may further comprise switching the fluid flow from the gas vent passage to the filtrate suction conduit as the drum rotates through substantially past a 5:00 position. The method may further comprise switching the fluid flow from the gas vent passage to the filtrate suction conduit as the filtrate conduits become substantially filled with filtrate.

DETAILED DESCRIPTION OF THE INVENTION

Figure 1:
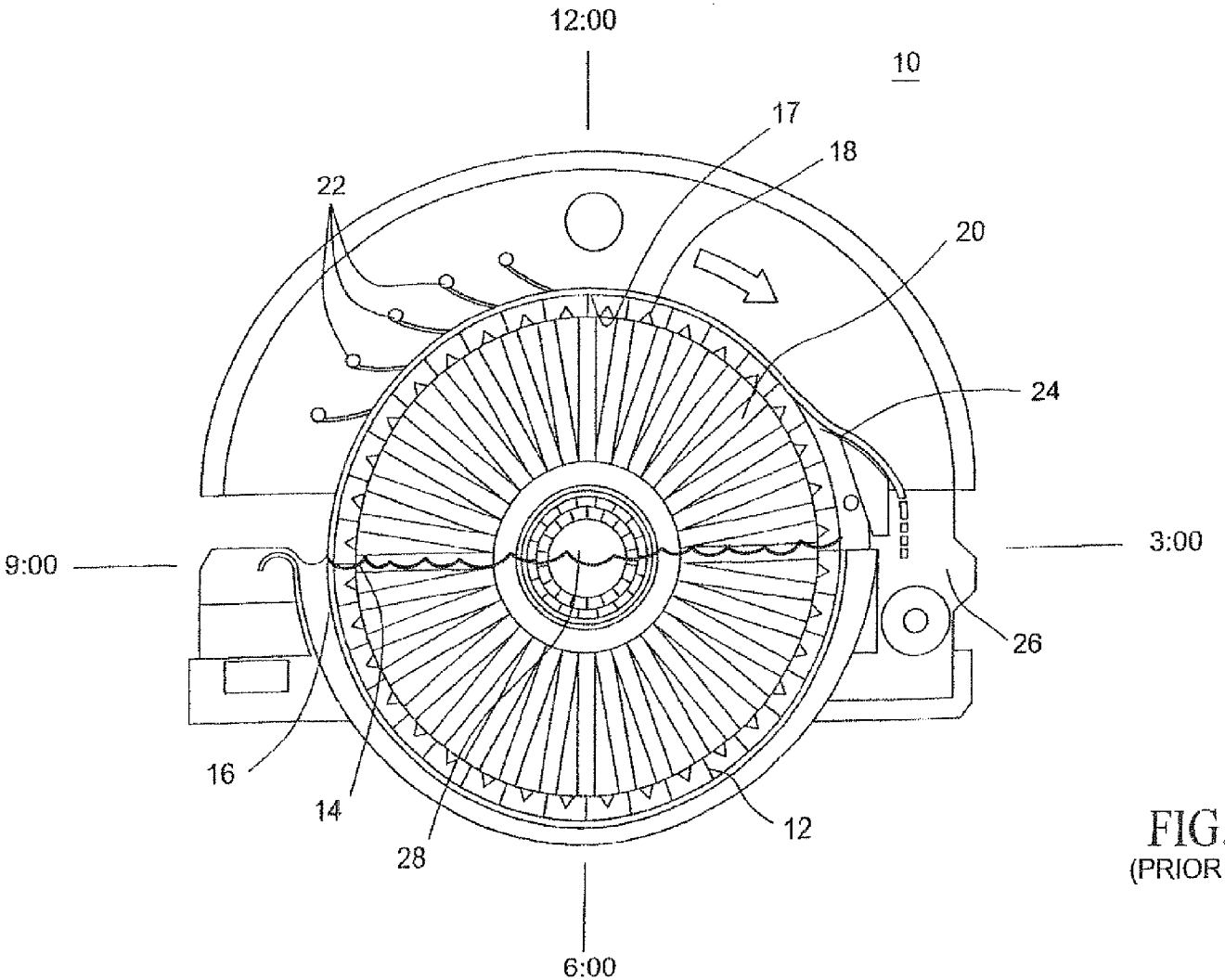
FIG. 1 (PRIOR ART)
FIG. 1 is a side view of a conventional rotary vacuum drum filter wherein the housing is shown in cross-section to expose the drum, vat and other interior components of the drum filter.
Figure 2:
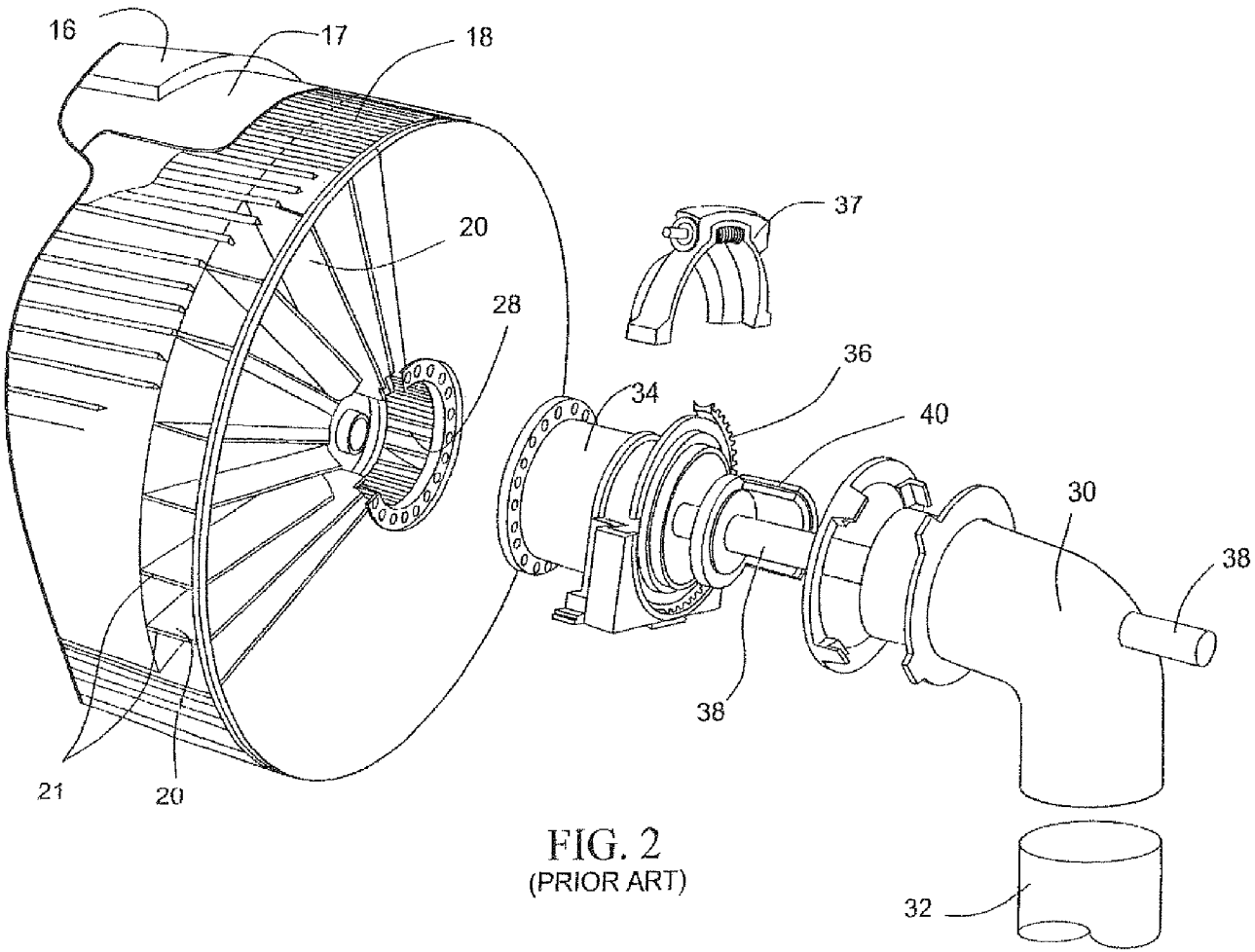
FIG. 2 (PRIOR ART)
FIG. 2 is a side, perspective view of a conventional rotary drum filter with the trunnion conduit, elbow and drop leg conduits shown in exploded view.
Figure 3:
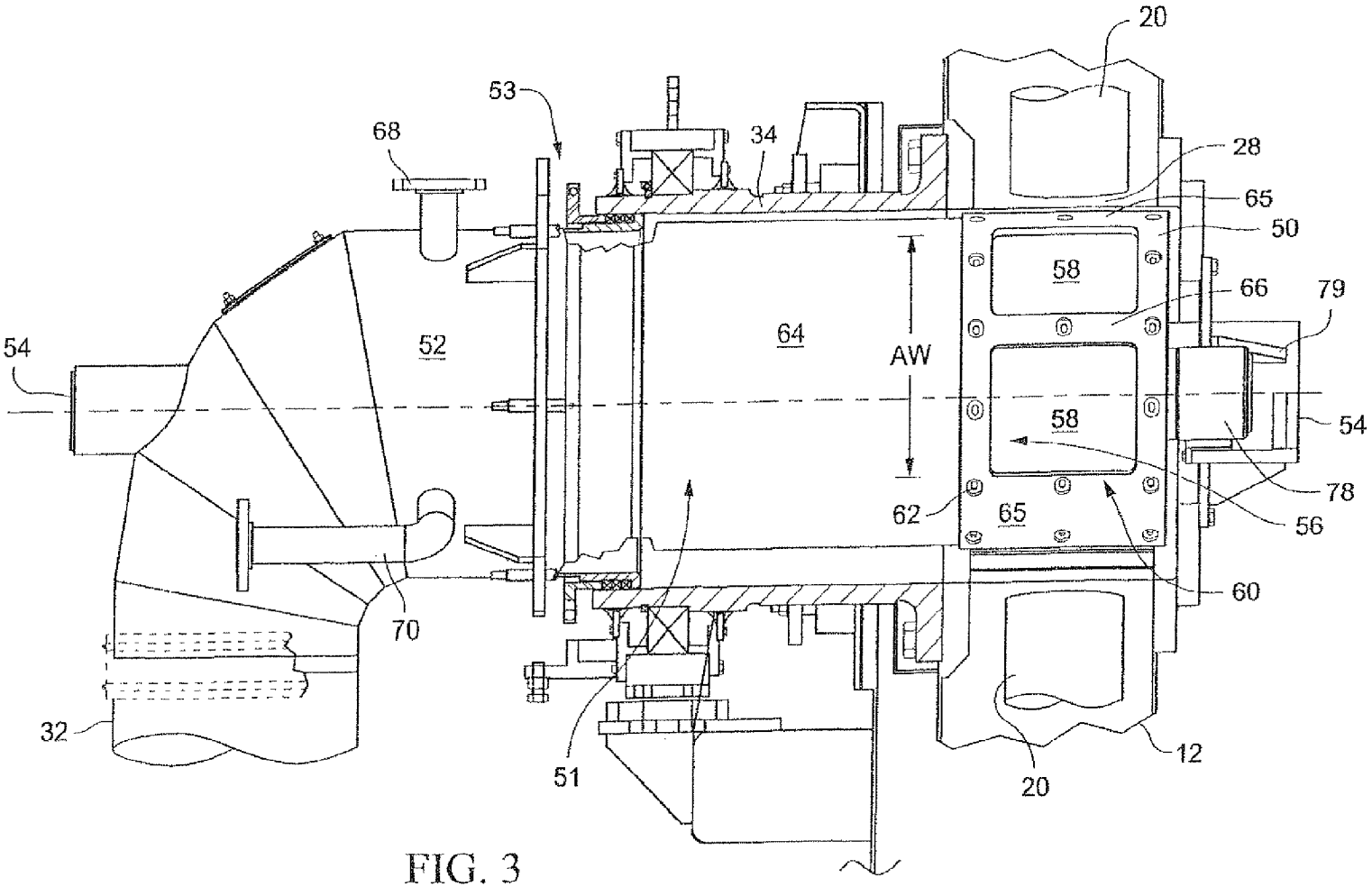
FIG. 3 is a side view of a front side of a valve segment and support mounted on an elbow conduit.

FIG. 3 is a perspective view of a front side of a valve segment 50 mounted on a cantilevered support 51 which extends from the inlet to an elbow conduit 52. The elbow and conduit are stationary and coupled to a trunnion conduit 34, such as is shown in FIG. 2. The elbow has a mounting bracket 53 that couples to the stationary drive and bearing unit, in a conventional manner. The discharge of the elbow is connected to a down leg conduit 32 that extends to a filtrate collection vessel that is preferably at least 30 feet (10 meters) below the drum filter washer.

The valve segment 50 may be a plate having an arc shaped in cross section. The valve segment 50 forms an arc of preferably about 130 degrees and extends preferably from the 1:00 to 5:00 positions with respect to the rotation of the vacuum drum. The valve segment is juxtaposed with the drainage outlets of the ribs 20 and extends into the filtrate chamber 28 in the drum 12. The valve segment is off-set from the centerline 54 of the trunnion conduit 34. The plate that forms the valve segment 50 includes one or more gas inlet apertures 58 arranged to be in alignment with the discharge of the ribs 20 in the drum. In the arrangement shown in FIG. 3, the gas aperture 58 is positioned at or near a distal end (opposite to the elbow) of the valve segment support 51.

The cantilever support 51 for the valve segment has a closed passageway 56 that extends from the valve segment plate 50 through the trunnion conduit 34 and into the elbow conduit 52. The passageway 56 allows gas and foam collected from the ribs 20 to be exhausted out of the filtrate drum and out of the elbow. The outlet of the passageway 56 includes an upper gas vent 68 and a liquid filtrate drain 70.

The gas aperture(s) 58 of the valve segment preferably extend collective a majority of the arc of the valve segment 50, as is shown in FIG. 3. In the embodiment shown here, the gas aperture(s) 58 collectively form an opening that extends up to about 100 degrees of the 130 degree arc formed by the valve segment. It is preferred that the aperture(s) 58 extend collectively at least 65 degrees.

Further, the gas aperture(s) 58 may extend from a near top drum position of the valve segment 50 to a lower position 60 on the valve segment that corresponds to where the ribs have been fully vented of gas and foam, and are entirely filled with liquid filtrate. The elevation of the liquid level in the vat typically corresponds to the centerline 54 of the drum 12. As the drum surface moves further into vat, liquid filtrate fills the ribs 20 and forces air and foam out of the ribs and into the aperture 58 of the valve segment. Preferably, the lower edge 60 of the aperture(2) 58 is at or below the angular drum position at which the ribs have been purged of air and foam. As shown in FIG. 3, the lower edge of the aperture 60 is at about the 4:00 position, plus or minus 5 degrees. The lower edge 60 may be determined for each drum based on the rotational drum position at which the ribs are filled with filtrate and no longer exhausting gas and foam.

The large cross-sectional area of the gas aperture(s) 58 in the valve segment 50 ensures that substantially all gases vented from the ribs enter the gas passage 56 in the valve segment even for relatively fast rotating drums. The aperture (s) 58 are relatively long (AW) in the direction of drum rotation. This length facilitates the venting of gases from the ribs 20 into the passage 56 as the ribs move across the length (AW) of the aperture 50. The low position, e.g., 4:00 to 5:00 position, of the lower edge 60 of the aperture 58 ensures that all air and foam are discharged from the ribs and into the passage 56.

The plate of the valve segment 50 may be mounted on an outer plate 64 of the valve segment support 51. The outer plate may have an arc cross-sectional shape that faces and conforms to the inside wall surface of the trunnion conduit. The valve segment 50 may be a plate that has an arc cross-sectional shape that conforms to the outer plate 64. The valve segment 50 is mounted, e.g., bolted, to the outer plate 64 and fits over an opening (not shown) in the outer plate 64.

The position of the valve segment 50 on the outer plate 64 may be adjustable, such as thorough the use of oval or racetrack slots 66 in the plate that receive the bolts that attach the plate 62 to the outer plate 64 of the valve segment support 51. Alternatively, the valve segment 50 may be welded to the outer plate 64 once the valve segment has been properly positioned with respect to the outlets to the ribs 20 in the drum.

By adjusting the position of the valve segment on the outer plate 64, the apertures 58 can be optimally positioned with respect to the angular movement of the drum and the outlet of the ribs 20. The ribs pass filtrate from the drum surface to a filtrate chamber 28. The ribs serve as drainage pipes for the drum. For example, the valve segment 50 may be moved slightly up or down on the support plate 64 to align the lower edge 60 of the aperture 58 to be sufficiently below the elevation at which the ribs 20 have fully discharged air and foam, and are discharging liquid filtrate. The valve segment may also be positioned laterally, e.g., parallel to the axis 54 of the drum axis, to be aligned with the discharge of the ribs 20.

The valve segment 50 may include a plurality of openings that define the gas aperture 58. Between the openings may be a support bar 66 integral with the plate of the valve segment and bisecting the plate. The support bar 66 provides structural stiffness for the valve segment and the apertures 58. The solid portions 65 of the valve segment (including the support bar) are relatively narrow (in the direction of AW) and have a relatively small cross-sectional area. Reducing the solid areas 65, 66 of the valve segments avoids unduly reducing the area of the aperture 58 or adversely disrupt the flow of gases into the gas vent passage 56.

The internal passage 56 in the valve segment support 51 vents gases that pass through the aperture(s) of the valve segment and are from the ribs and filtrate chambers. The passage 56 is offset from and extends above and below the centerline 54 of the trunnion conduit and drum axis. The lower portion of the passage is preferably at or just below the bottom edge 60 of the apertures 58. Similarly, the lower portion of the passage 56 should be at or just below the angular position of the drum in which the ribs are filled with filtrate and gases and foam have been exhausted from the ribs.

The internal passage 56 may extend from the inlet aperture (s) 58 of the valve segment 50 and to the elbow 52. The passage 56 may have a gas vent 68 at an upper end of the passage and elbow, e.g., above the centerline 54. The passage 56 also has a filtrate drain extending out of the passage and through the elbow. The filtrate drain is at a lower portion of the passage 56 and below the centerline 54 of the trunnion conduit and drum axis and preferably below the elevation of the lower edge 60 of the aperature(s) 58. A substantial amount of filtrate may pass through the passage 56 as air and foam are discharged from the ribs into the passage. Further, liquid filtrate in the ribs may serve a purging action to push out air and foam from the ribs and the pushing liquid filtrate may flow into the passage 56.

Alternatively, the valve segment 50 may be integrated into the valve segment support such that the distal end of the outer plate constitutes the valve segment and openings in the outer plate constitute the gas apertures leading to the gas passage 56. Further, the outer plate 64 and valve segment support 51 may be formed by a sturdy tube having a relatively large cross-sectional area and offset from and lower than the axis 54 of the drum. The tube may have an oval or kidney shaped cross-section to reduce the blockage to fluid flow in the trunnion conduit and conform to the inside wall surface of the trunnion conduit.

Figure 4:
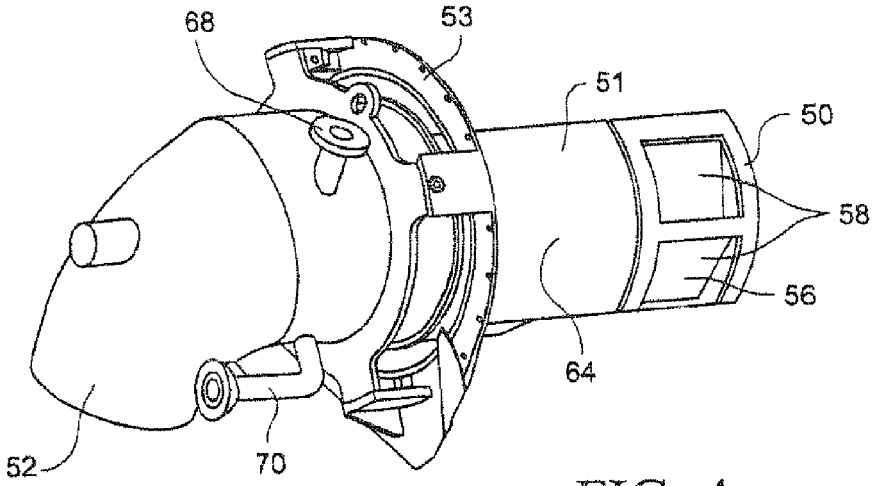
FIG. 4 is a perspective view of a front side of a valve segment and support mounted on the elbow conduit shown in FIG. 3.

FIG. 4 is a perspective view of a valve segment 50 supported by a valve segment support 51. The valve segment is mounted on an outer plate 64 of the support. The support 51 is attached to the elbow conduit 52 and extends as a cantilever to the segment. A mounting bracket 53 provides a coupling for the elbow to the stationary drive and bearing unit.

Figure 5:
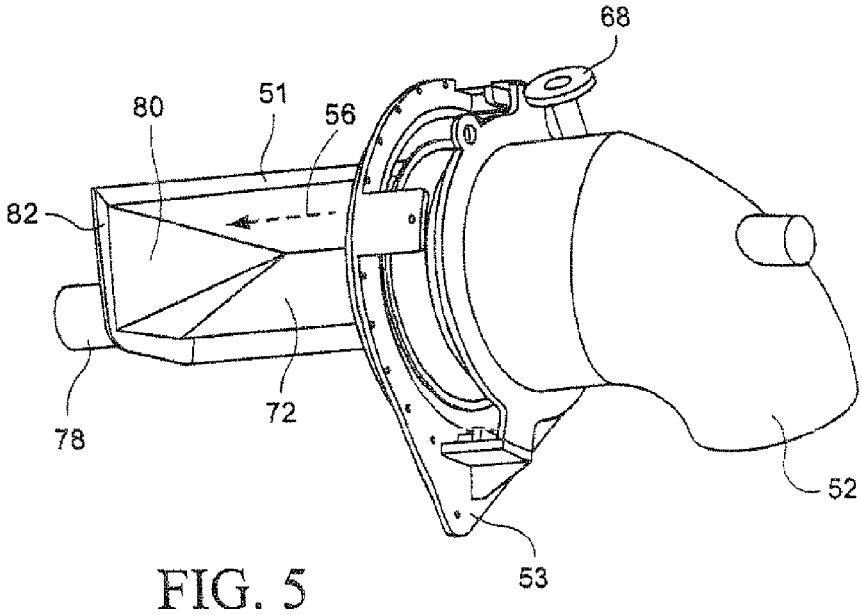
FIG. 5 is a perspective view of a rear side of the valve segment and segment support mounted on the elbow conduit shown in FIG. 3.

FIG. 5 is a perspective view of a rear plate of the valve segment support 51. The valve segment support may be formed by welding together the pair of plates 64, 72 along their respective upper and lower edges. The outer plate 64 forms the front surface of the valve segment support and may have an arc shape that generally conforms to the inner wall of the trunnion conduit. The rear plate 72 may be an arc, flat or bent inward along a crease line (as shown in FIG. 5).

The rear plate 72 and outer plate 64 of the valve segment support 51 form a sturdy support and the gas vent passage 56. The valve segment support may extend as a cantilever from the inlet of the elbow 52 into the trunnion conduit. A cylindrical post 78 on the distal end of the valve segment support may fit into a bushing (FIG. 3) in the drum axel and inward of the axial filtrate chamber. Further, a triangular brace 80 may be welded to an inside surface of the rear plate 72 to provide additional support for the valve segment support.

The internal gap between the front and rear plates of the valve segment support defines the gas passage 56. End caps 82 welded to opposite longitudinal ends of the plates seal the ends of the passage. The passage 56 may alternatively be a tube extending along a back surface of the outer front plate and thereby render the rear plate optional.

The valve segment 50 provides a means for removing the air from filter drum before the air enters the drop leg. The valve segment allows the ribs to vent gases into the passage 56 for substantially the entire rotational period during which the suction is not applied to the ribs. Further, the valve segment allows gas and foam from the ribs to vent entirely into the passage 56 (along with a substantial amount of liquid filtrate) to minimize air entering the elbow and down leg conduits. These features are contrary to the conventional approach of blocking liquid fluid flow through the ribs during most of the portion of the rotational in which suction is not applied to the ribs.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of treating pulp including the formation of a pulp web on a porous surface of a rotating drum cylinder having a lower drum portion in a vat of pulp slurry and a radial array of filtrate conduits draining filtrate passing through the porous surface to an axial filtrate chamber, the method comprising:

rotating the drum about an axis of the drum;

as the porous surface of the drum rotates through the vat, drawing filtrate from the slurry through the porous surface by a suction applied to the filtrate conduits;

draining the filtrate from the filtrate conduits to the axial filtrate chamber and to a filtrate suction conduit extending to an elevation below the vat;

forming a pulp mat on the porous surface which passes filtrate and substantially blocks fibers;

removing the pulp mat on the porous surface from the vat as the drum rotates;

continuing the draining of filtrate from the filtrate suction conduit as the filtrate conduits are rotated through angular positions during which liquid filtrate applied to the surface of the pulp fills the conduits, and after liquid filtrate is no longer applied to the pulp mat and before excessive gases passing through the porous surface enter the filtrate conduits, switching a fluid flow downstream of the filtrate conduits from a path directed through the filtrate suction conduit and to a gas vent passage, wherein the gas vent passage is offset and below the axis of the drum.

2. A method as in claim 1 wherein the switch from the path directed to the filtrate suction conduit and to the gas vent passage occurs at substantially a 1:00 rotational position of the drum and said method further comprises switching the fluid flow from the gas vent passage to the filtrate suction conduit as the drum rotates through substantially a 5:00 position.

3. A method as in claim 1 wherein the gas vent passage includes a gas vent and a filtrate drain, wherein the filtrate drain is below elevation of a surface of the slurry in the vat.

4. A method as in claim 1 further comprising switching the fluid flow from the gas vent passage to the filtrate suction conduit as the filtrate conduits become substantially filled with filtrate during the drum rotation.

5. A method as in claim 1 wherein gases vent to the gas vent passage from the filtrate conduits while the filtrate conduits are substantially filled with air.

6. A method of washing a pulp mat on a porous surface of a rotating drum cylinder having a lower drum portion in a vat of pulp slurry and a radial array of filtrate conduits, the method comprising:

rotating the drum cylinder about a rotational axis;

forming the pulp mat on the porous surface as the drum rotates the porous surface through the vat;

drawing filtrate from the slurry in the vat through the porous surface by applying a suction to the filtrate conduits;

elevating the pulp mat on the porous surface above the vat as the drum rotates;

draining the filtrate by a filtrate flow from the filtrate conduits through the filtrate chamber and to a filtrate suction conduit extending to an elevation below the vat, and as the drum rotates, switching the filtrate flow through the filtrate conduits from a path through the filtrate suction conduit to a path through a gas vent passage offset and below from the drum rotational axis.

7. The method in claim 6 wherein the filtrate flow to the gas vent passage includes gases drawn through the pulp mat and porous surface and into the filtrate conduits.

8. The method of claim 7 wherein gases vent to the gas vent passage from the filtrate conduits while the filtrate conduits are substantially filled with air.

9. The method in claim 6 wherein the switch of the filtrate flow occurs at substantially a 1:00 rotational position of the drum.

10. The method in claim 6 further comprising switching the filtrate flow through the filtrate conduits from the gas vent passage to the filtrate suction conduit as the filtrate conduits are rotated towards the vat.

11. The method of claim 10 wherein the filtrate flow is switched from the gas vent to the filtrate suction conduit as the drum rotates through substantially a 5:00 position.

12. The method of claim 6 wherein the gas vent passage includes a gas vent and a filtrate drain, wherein the filtrate drain is below an elevation of a surface of the slurry in the vat.

13. The method of claim 6 further comprising switching the filtrate flow from the gas vent passage to the filtrate suction conduit as the filtrate conduits become substantially filled with filtrate.

14. The method of claim 6 wherein gases vent to the gas vent passage from the filtrate conduits during at least one hundred and eight degrees of angular rotation of the drum.

* * * * *